US005230674A

United States Patent [19]

Terauds

[11] Patent Number: 5,230,674

[45] Date of Patent: Jul. 27, 1993

[54] COMBINATION EXERCISER AND BAGGAGE CARRIER

[76] Inventor: Juris Terauds, 1501 West Lake, Fort Collins, Colo. 80521

[21] Appl. No.: 992,380

[22] Filed: Dec. 17, 1992

[51] Int. Cl.[5] ..... A63B 22/04

[52] U.S. Cl. ..... 482/52; 482/148

[58] Field of Search ..... 482/51, 52, 53, 111, 482/112, 113, 148, 71, 72

[56] References Cited

U.S. PATENT DOCUMENTS

| | | | |
|---|---|---|---|
| 1,909,190 | 5/1933 | Sachs . | |
| 3,022,071 | 2/1962 | Malone et al. | 272/57 |
| 3,197,226 | 7/1965 | Erlinder | 280/36 |
| 3,295,847 | 1/1967 | Matt, Sr. | 272/83 |
| 3,511,500 | 5/1970 | Dunn | 272/79 |
| 3,572,758 | 3/1971 | Lee | 280/296 |
| 3,628,791 | 12/1971 | Garcia | 272/83 R |
| 3,747,924 | 7/1973 | Champoux | 272/79 R |
| 3,756,595 | 9/1973 | Hague | 272/70 |
| 3,758,112 | 9/1973 | Crum et al. | 272/79 C |
| 3,792,860 | 2/1974 | Seines | 272/58 |
| 3,814,420 | 6/1974 | Encke | 272/83 R |
| 3,970,302 | 7/1976 | McFee | 272/130 |
| 4,248,453 | 2/1981 | Stark | 280/655 |
| 4,371,160 | 2/1983 | Shooltz | 272/96 |
| 4,426,099 | 1/1984 | Gross | 280/655 |
| 4,563,001 | 1/1986 | Terauds | 272/72 |
| 4,570,958 | 2/1986 | Walker | 280/40 |
| 4,824,167 | 4/1989 | King | 297/129 |

FOREIGN PATENT DOCUMENTS

| | | |
|---|---|---|
| 923517 | 3/1973 | Canada . |
| 0073744 | 9/1983 | European Pat. Off. . |
| 2261989 | 6/1974 | Fed. Rep. of Germany . |
| 2428515 | 2/1976 | Fed. Rep. of Germany . |
| 2002808 | 2/1969 | France . |

OTHER PUBLICATIONS

Interwood Marketing Limited and/or The Home Shoppe-Fitness F/X; Easy Step; as early as Sep. 1991.

*Primary Examiner*—Stephen R. Crow

*Attorney, Agent, or Firm*—Luke Santangelo; Robert W. Diehl

[57] ABSTRACT

A combination exerciser and baggage carrier having a rigid, main frame (11), force resistive pistons (17), force engaging plates (12a–b), handle portion (37), wheels (36), and a load supporting plate (32), is capable of selective engagement of either operational mode. The exerciser may be embodied as any number of cardiovascular workout devices, including stair stepping simulator (10), rowing machine simulator (40), walking/running simulator (50), and weight lifting machine (60). The baggage carrier is of the type used in areas catering to mass transportation travels, such as airports, and bus and train depots, and may similarly vary in embodiments, from standard two-wheeled carrier (30) to a multiple wheeled, horizontal push cart. The exerciser/-baggage carrier is designed to tote one's baggage conveniently, then when such service is no longer required it is capable of space saving compaction, until when an opportunity arises, such as in a hotel room, office, park, etc., the present invention may be converted to an exerciser suitable for facilitating a substantial cardiovascular workout.

40 Claims, 18 Drawing Sheets

Step 3

Step 4

Step 5

Step 3
11
32
65

Step 4
17
12b
12a 19
18
28
20
21
28
10
Step 5

47

COMBINATION EXERCISER AND BAGGAGE CARRIER

FIELD OF THE INVENTION

The present invention relates generally to the field of exercising equipment and the field of baggage toting devices, such as those used typically in airports, bus and train stations, and the like. Specifically, the present invention relates to convertible exercising equipment which may be used to conveniently tote baggage under desirable circumstances.

BACKGROUND OF THE INVENTION

A trend began a number of years ago when few people were able to join their neighborhood health clubs, for one reason or another. Some found the yearly, monthly, or weekly dues too expensive. Others could not find the time in their schedule to attend regularly. Still others had no local health clubs to attend. With memberships on the decline, health fitness clubs began closing down as quickly as they had sprung up. These phenomenon, it is believed, are what led to the "home fitness" trend.

Home fitness devices include the infinite number of workout and aerobic tapes, as well as home gyms, rowing machines, walking simulators, skiing simulators, running simulators, stair stepping simulators, and more. Each of these devices are designed to work specific muscle groups, but more importantly to provide a cardiovascular workout at home. Naturally, it was but a short time before persons with these devices began taking them to the office, on vacation, on business trips, practically wherever they went.

Unfortunately, regardless of how small these exercising devices could be made by the designers and manufacturers, they would always be additional baggage for travelers to carry. The present invention solves this problem, as well as many others related to portable exercising equipment, and some problems related to travel in general.

With respect to the field of wheeled baggage devices, carriers are typically manufactured for a single purpose—toting baggage. Frequent travelers might forego the purchase of such a device merely because of its limited usefulness. This is not the case with the present invention. Its necessary sturdy construction makes itself applicable to a variety of tasks. While prior art devices are capable of being collapsed, folded, or compacted for convenient storage, the present invention—while it too can be easily compacted for storage—is capable of much more.

Both of the implicated industries, by misidentifying the difficulties that faced travelers, had created problems they were perhaps incapable of completely solving. Each separately focused on making their devices smaller, more compactable, and lightweight. This is evidenced by U.S. Pat. Nos. 4,570,958 to Walker, 4,563,001 to Terauds, 4,426,099 to Gross, 4,371,160 Shooltz, 4,248,453 to Stark, 3,970,302 to McFee, 3,295,847 to Matt, Sr., 3,511,500 to Dunn, and 3,197,226 to Erlinder. Each of the devices in these references discloses either a portable exerciser, or a compactable luggage carrier. None of the known prior art devices has disclosed the combination of elements from each field to produce a more useful, dual operation device. The present invention is the first of its kind to pull the two seemingly unrelated fields together. It has served to bridge an expanse that might have otherwise existed for a longtime to come.

In U.S. Pat. No. 3,572,758 to Lee, a multipurpose device is disclosed for use in connection with a bicycle. This device is not related to the present invention, especially in that the type of carrier involved is demonstrative of vehicle-type luggage carriers, not hand pushed wheeled carriers. Furthermore, as bicycles typically use these types of luggage carriers, the application of one field, vehicle luggage carriers, to the other, stationary bicycle exercise stands, is in no way indicative of the true difference between the two fields.

In another patent, U.S. Pat. No. 4,824,167 to King, a multipurpose device is disclosed which converts from a chair to a baggage carrier. This baggage carrier is of the type considered relevant to the present invention. However, King's approach to find other utility features for a baggage carrier has taken a direction very different from that of the present invention. The King reference teaches conversion from a baggage carrier to a relaxation device, not a device for facilitating a cardiovascular workout, as in the present invention.

The present invention, in its various embodiments, recognizes and addresses the issues and problems involved in the two fields, and overcomes many limitations encountered by those skilled in the respective arts. Many devices and procedures have taught exercising techniques for home use, as well as travel. Likewise, many devices and procedures have taught the use of compactable baggage carriers. However, all of these teachings have failed to address both issues with a single device. This is not surprising, since the present invention is believed to be the first to have considered these previously unrelated fields. Other approaches, such as those of Lee and King, have combined the field of stationary bicycle stands with the field of vehicle luggage carriers, or the field of wheeled baggage carriers with the field of chairs. Until the present invention, no one had taken the approach of combining the field of wheeled baggage carriers with the field of portable exercising equipment, despite the long felt need for such combination, and the existence of the necessary implementing arts. Certainly problems such as toting bulky exercise equipment on trips, or stowing away useless baggage carriers between travels have existed, but such problems have gone unidentified by those skilled in the art. The recognition by the present inventor that the problems encountered in the two fields could be solved by crossing over the boundaries of these fields and combining basic elements from each lead to the present invention. While various aspects of the present invention have been known for some time, and while they may have been used in numerous other fields, those skilled in the relevant arts have failed to recognize their value as solutions in the present field. The prior art has shown a level of teaching away from the present invention by providing a wheeled baggage carrier in combination with a chair rather than combining the same with an exercising device. Rather than supplying an apparatus which affords only an incremental increase in performance and design over the prior art, the present invention utilizes a realization and understanding of certain desires of travelers, which were not previously considered, to achieve leaps in performance compared to the prior art.

SUMMARY OF THE INVENTION

The present invention discloses an exerciser designed to operate in conjunction with a wheeled baggage carrier, such as used in toting one's baggage in an airport, bus or train station, or the like. The device provides a reliable and effective means for facilitating a cardiovascular workout attached to a rigid main frame. This invention serves to provide useful workout facilities for travelers, to minimize efforts during travel by allowing the device to be converted and used as a baggage carrier, and to optimize space utilized by providing a compactable device for storage.

In general terms, the invention involves various embodiments of an exerciser as well as various embodiments of a baggage carrier. Many of the elements of this device achieve several different objects in the different modes of operation. In the preferred embodiment, the invention discloses a main rigid frame which acts as a central support to allow conversion from one operational mode to the other by manipulation of the attached elements. The device may also feature a storage bag which permits the invention to be stored away and carried about without any significant effort, it also prevents the damage and/or loss of components which may occur as the invention is placed in a car trunk or the like. Still other features of the present device include a rolling means which allows for the realization of baggage transport with great ease.

Importantly, the invention breaks from several time-honored traditions in exercise devices. While drawing from some of the important conditions demanded of these devices for providing an effective cardiovascular workout, the invention expands upon these conditions in an effort to provide a more utilizable device during travel. By recognizing and utilizing the advantages of baggage carriers, and designing such advantages into an exercising device the present invention achieves its goals.

Accordingly, the present invention provides an exerciser which may be converted and used as a baggage carrier. The stated exerciser acts to facilitate a cardiovascular workout in the user. The exerciser may include a variety of different force resistive means which interact with force engaging plates during actuation. In addition, a seat can be used on the main frame of the exerciser in particular embodiments. To properly and adjustably control the force resistive means, a fluid flow control valve may be connected between the two (or more) resistive means to permit opposing interaction as fluid flows between the means. The stated baggage carrier acts to permit the toting of baggage while retaining the exercising constituents of the present invention in an inactive manner. The baggage carrier is equipped, in one embodiment, with a handle portion, load supporting plate, and single rolling means to precipitate travel. Other embodiments are anticipated which facilitate toting baggage in various specific manners.

In one embodiment, it is an object of the present invention to provide a design having dual pedals engaged with resistive hydraulic pistons for facilitating a cardiovascular workout. The pedal/piston design may be arranged in a fashion to resemble a stair climbing device, in which substantially vertical steps are taken to operate the device. Alternatively, the pedal/piston design may be arranged in a fashion to resemble a walking or running simulator, in which substantially horizontal strides are taken during operation. Alternatively, the pedal/piston design may be arranged in a fashion to resemble a rowing simulator, in which substantially horizontal arm movements are employed during operation. Optionally, the pedal/piston design may be arranged in a fashion to resemble a weight lifting device, in which vertical and/or horizontal movements are used during operation.

It is an object of the present invention to provide a design having load supporting means for permitting operation as a baggage carrier. Additionally, a handle portion and a pair of wheels are used for control and mobility. Extra wheel pairs may be used in other embodiments.

It is another object of the present invention to provide a design having the ability to conveniently convert from the exercising mode of operation to the baggage carrier mode of operation. It is therefore an object to inactive one mode in favor of the other. An object is therefore to have all possible elements of the present invention capable of retraction, removal, folding, or, in general, compaction. It is subsequently an object of the present invention to be capable of a reduced volume to permit storage during inactivity of both operational modes.

Naturally, further objects of the invention are disclosed throughout other areas of the specification and claims.

BRIEF DESCRIPTION OF THE DRAWINGS

The following descriptions and referenced drawings are for selected preferred embodiments of the present invention. Naturally, changes may be made to the disclosed embodiments while still falling within the scope and spirit of the present invention and the patent granted to its inventor.

DETAILED DESCRIPTION OF THE PREFERRED EMBODIMENTS

Figure 1:
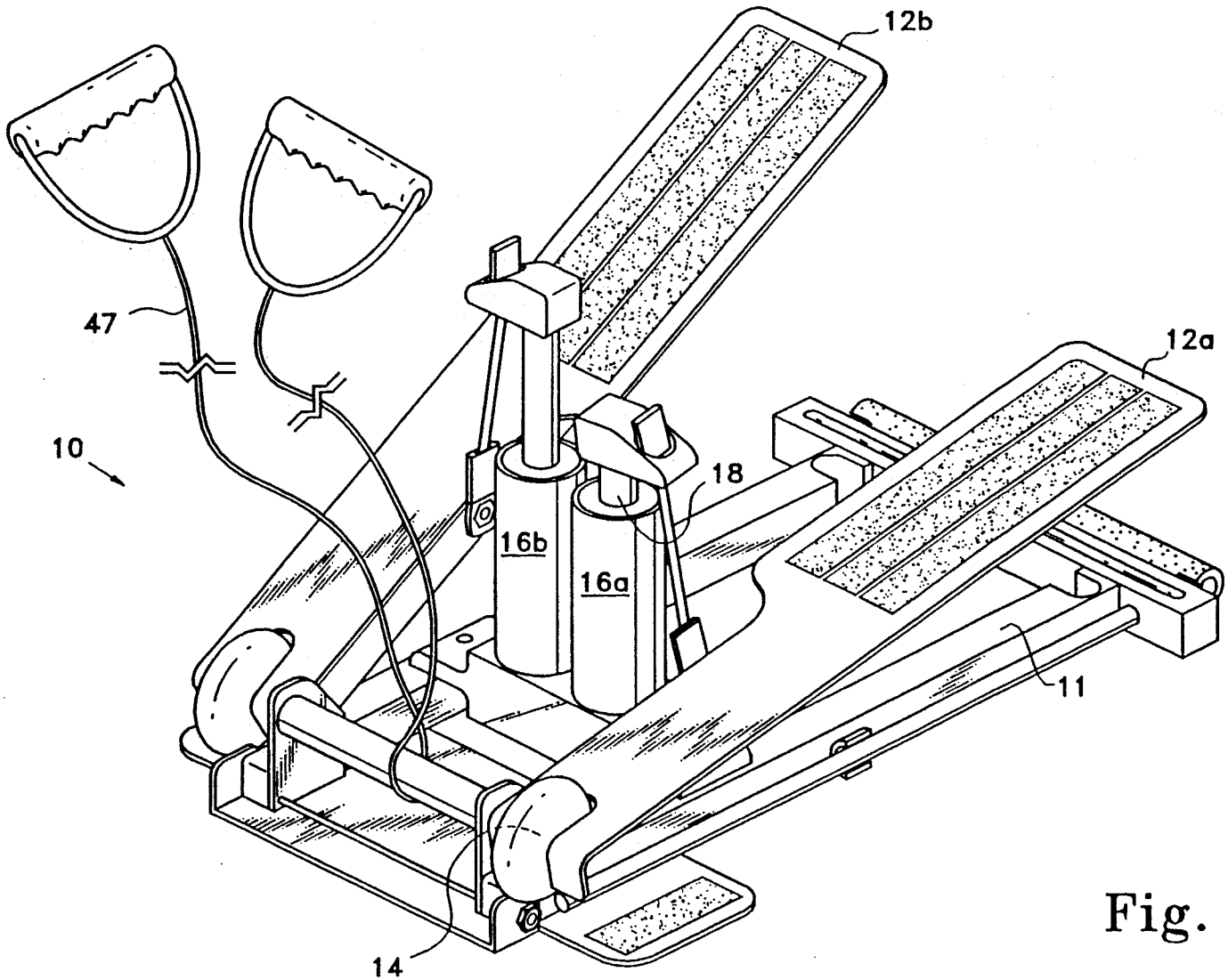
FIG. 1 is a perspective view of one embodiment of the present invention, shown in the exercising mode of operation.
Figure 2:
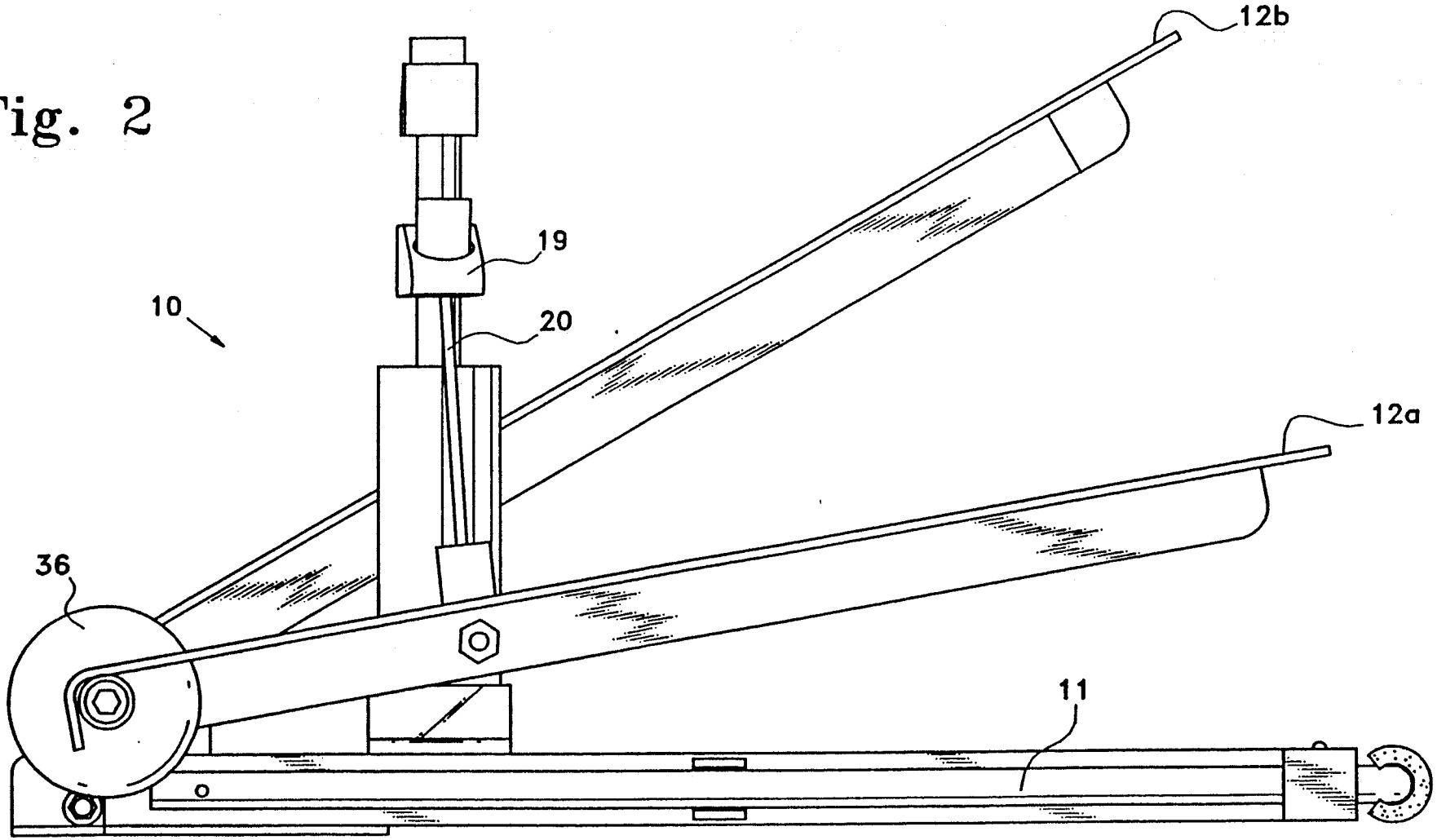
FIG. 2 is a side view of the embodiment shown in FIG. 1.
Figure 17:
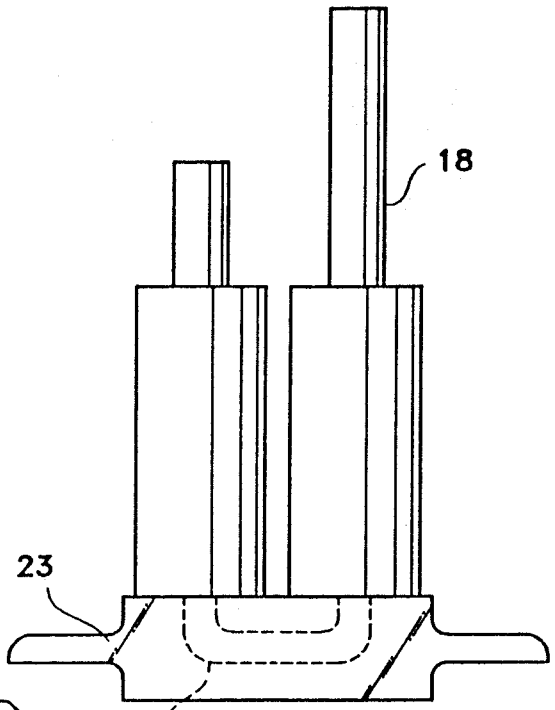
FIG. 17 is a front view of the hydraulic piston system used in the embodiment shown in FIG. 1.

As can be seen from the drawings, the basic concepts of the present invention may be embodied in many different ways. FIG. 1 shows a perspective view of one such embodiment, stair stepping simulator (10). Stair stepping simulator (10), as shown in the embodiment of FIG. 2, is equipped with main frame (11), left and right force engaging plates (12*a* and 12*b*, respectively), and left and right (or first and second) resistive means (16*a* and 16*b*, respectively). Force engaging plates (12*a–b*) are directly responsive to the reciprocating action of resistive means (16*a–b*), and vice versa. That is, for instance, as plate (12*a*) engages a downward force it descends, forcing rod (18) of resistive means (16*a*) downward—each resistive means has a definitive length of travel, approximately 3½ inches in the present embodiment. Due to the opposingly interactive nature of these reciprocating members, resistive means (16*a–b*), as provided by fluid transfer zone (22) shown in FIG. 17, (16*b*) is forced into an ascending travel, which of course causes force engaging plate (12*b*) to do likewise. Fluid transfer zone (22) allows this continuous alternating direction of force engaging plates (12*a–b*).

While particular embodiments of the invention will be described, it will be obvious that changes and modifications may be made without departing from the broad aspects of the present invention. Such modifications and changes are not limited to those listed throughout the disclosure of the present invention, but it is intended that such should include those alternatives well known by those skilled in an art, and any others which operate in substantially the same way to achieve substantially the same result.

As a means for facilitating a cardiovascular workout, which is maintained integral to main frame (11), simulator (10) may be mounted so that either hands or feet may be used and may be operated by shifting the applied force from plate (12*a*) to plate (12*b*) which act to resist the applied force. This process may be repeated for a desired period. When working the legs elastic bands (47) may be used to simultaneously work the arms. Elastic bands (47) are attached to main frame (11) at points proximate to pivot point (14) of force engaging plates (12*a–b*). Bands (47) offer additional and/or alternative resistive means in many disclosed embodiments. Naturally, other configurations are possible, and should be considered to fall within the scope of this invention. During this reciprocating process, simulator (10) may remain stationary.

Figure 9A:
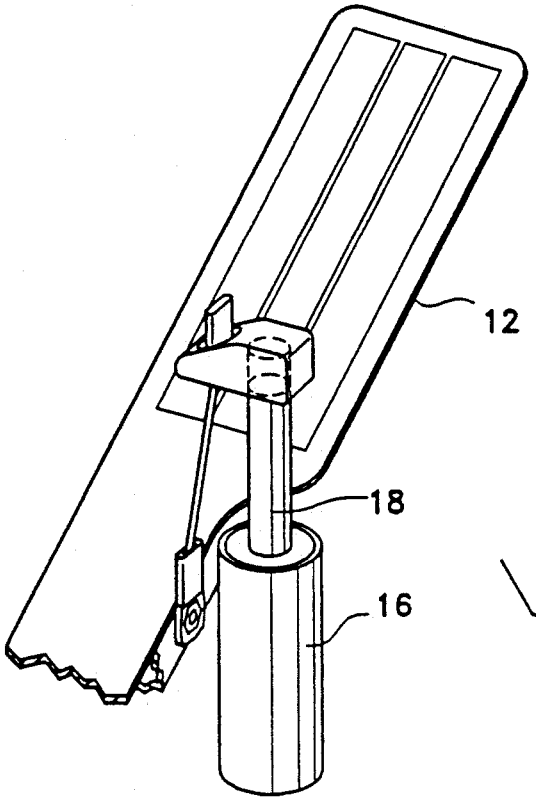
FIGS. 9*a–d* show a few various embodiments of the resistive means which may be used in the present invention.
Figure 9B:
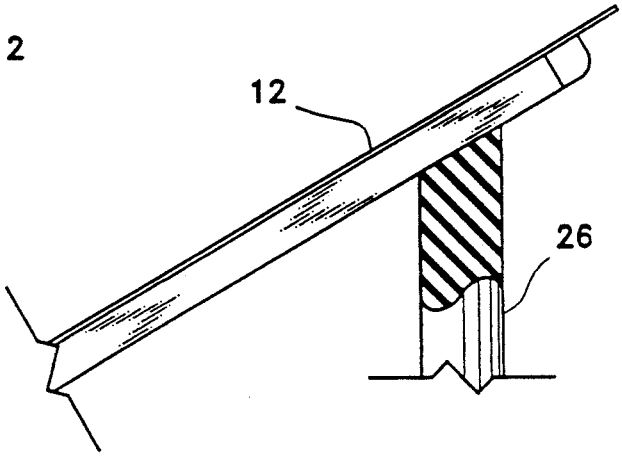
Figure 9C:
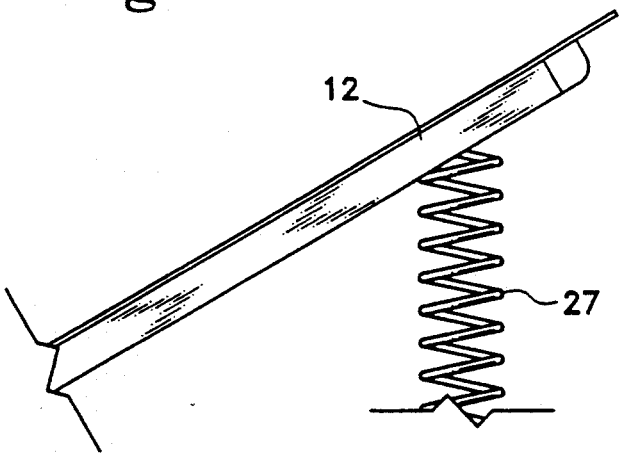
Figure 9D:
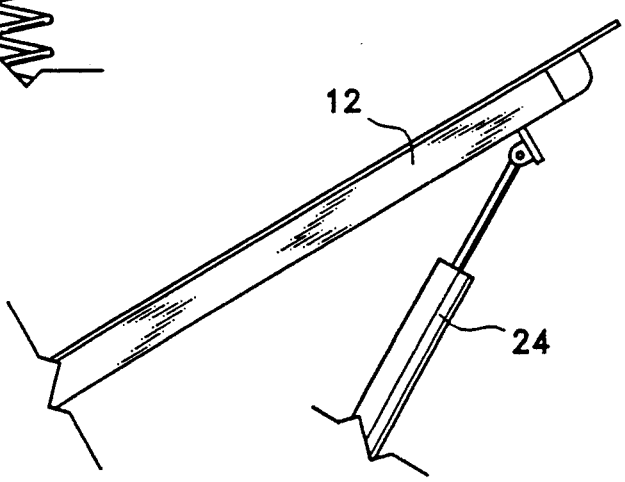
Figure 18:
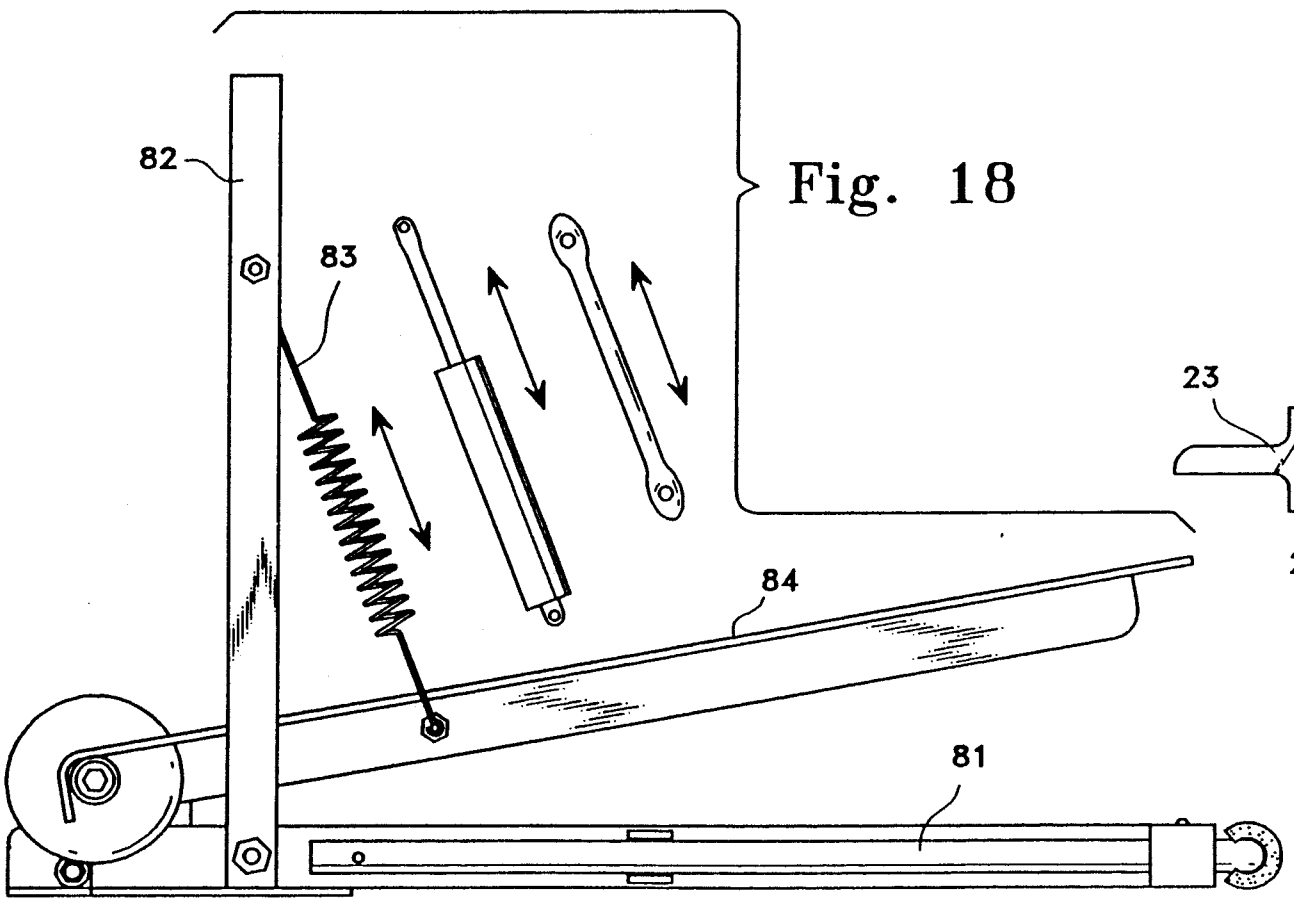
FIG. 18 is a side view of another embodiment of the present invention showing an anticipated design where the resistive means is attached above the force engaging plates.

Additionally, the force necessary to descend plates (12*a–b*) may be constant or variable. The variability can be achieved in numerous ways known by those skilled in the exercising act, such as variable resistive pistons, variable resistive springs, and the like. A constant load is as easily achievable with constant resistive pistons, springs, and the like. FIGS. 9*b–d* illustrate a few plausible resistive alternatives to FIG. 9*a*, which shows the preferred embodiment. FIG. 9*b* shows compressible rubber composite (26) which may produce variability, for instance, by using gradually increased density toward the bottom. Alternatively, composite (26) can be made hollow to function as an air bellows. This will also work well as a resistive means. FIG. 9*c* is illustrative of variable resistance spring (27), while FIG. 9*b* shows angled piston (24), each suitable for mounting beneath plates (12*a–b*). It should be understood, however, that the placement of resistive means (16) is not limited to attachment below plates (12*a–b*). FIG. 18 shows an anticipated embodiment where handle portion (82) pivots to a position approximately perpendicular to main frame (81). Resistive means (83), shown as an extensible spring, is attached from handle portion (82) to force engaging plates (84). Basically, whatever resistive means are employed, they need only to operate to substantially cause resistance—either through compression, extension, or friction—and to achieve substantially the same result, a workout. Each of the variable resistive means shown in FIGS. 9*a–9d* will serve to increase the amount of work performed by the user as resistivity is increased (distance traveled remains constant).

Figure 11:
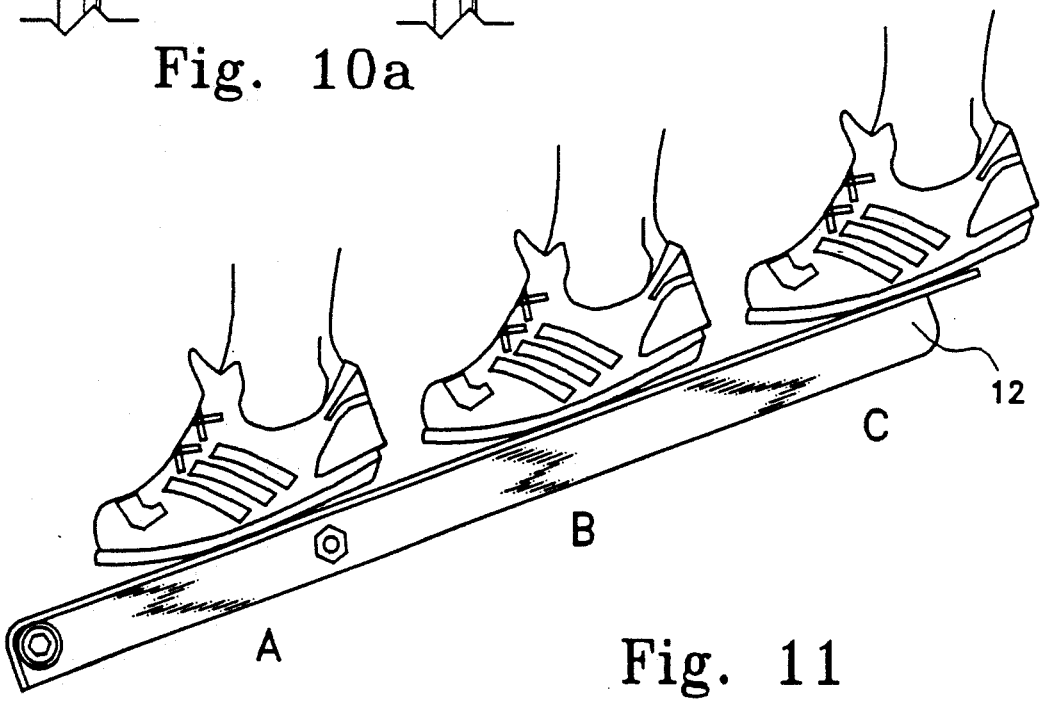
FIG. 11 is a side view illustrating one method by which the necessary force may be varied. Points A, B, and C denote three possible load placements which will exhibit different force requirements.

Alternatively, or in addition, the necessary force can be varied more simply by the user. Referring to FIG. 11, the user may incrementally move forward or backward on plate (12) to change the force exerted. For instance, standing at point A would require greater force than at point B, which in turn would require greater force than at point C. This is well understood in the art and detailed in [pending U.S. application Ser. No. 07/890689] to the inventor of this application. This reference is hereby incorporated by reference, thereby supplementing the disclosure of this application. Naturally, the work performed by the user in this mode would not change for the same number of repetitions at point A, B, or C.

Referring now to FIGS. 5*a–e* the means for selectively engaging the means for facilitating can be seen. FIGS. 5*a–e* show the steps and means for converting simulator (10) to baggage carrier (30). In step 1 simulator (10) is shown engaged with pistons (17) upright and responsive to force engaging plates (12). Step 2 illustrates the means for disengaging resistive means (16) by detachment of pistons (17). This is achieved by removing cap (19) from rod (18) of piston (17). Step 3 shows how pistons (17) may be stored within main frame (11) by placing base (23) into integral notches (28). Force engaging plates (12) then lay flat upon frame (11) and are secured in place by elastic cord (31). Many other means for securing force engaging plates are anticipated, such as latches, and should be considered to fall within the scope of the present invention. At this point means for facilitating a cardiovascular workout, namely stair stepping simulator (10), is inactive and inoperable. This is the compacted stage of the present invention.

Continuing with the means for selectively engaging baggage carrier (30), step 4 shows the manipulation of main frame (11) to a vertical position with wheels (36) downward. Load supporting plate (32) is pivoted approximately 90° at pivot point (35) as well. Finally, in step 5, handle portion (37) is extended to complete the selective engagement of baggage carrier (30). Handle portion (37) provides a means for guiding carrier (30). At this point baggage may be loaded onto plate (32), and secured with elastic band (47) for easier travel.

Figure 3:
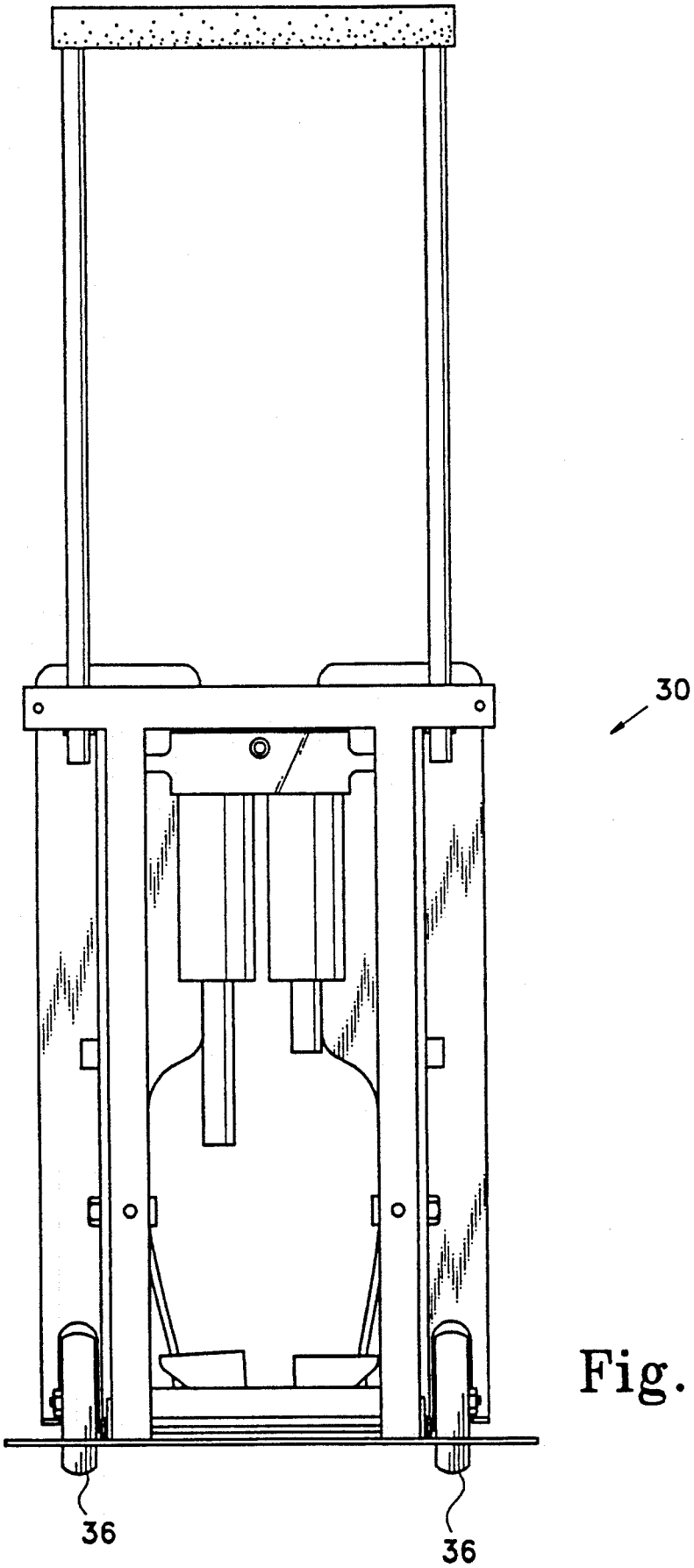
FIG. 3 is a front view of one embodiment of the present invention, shown in the baggage toting mode of operation.
Figure 4:
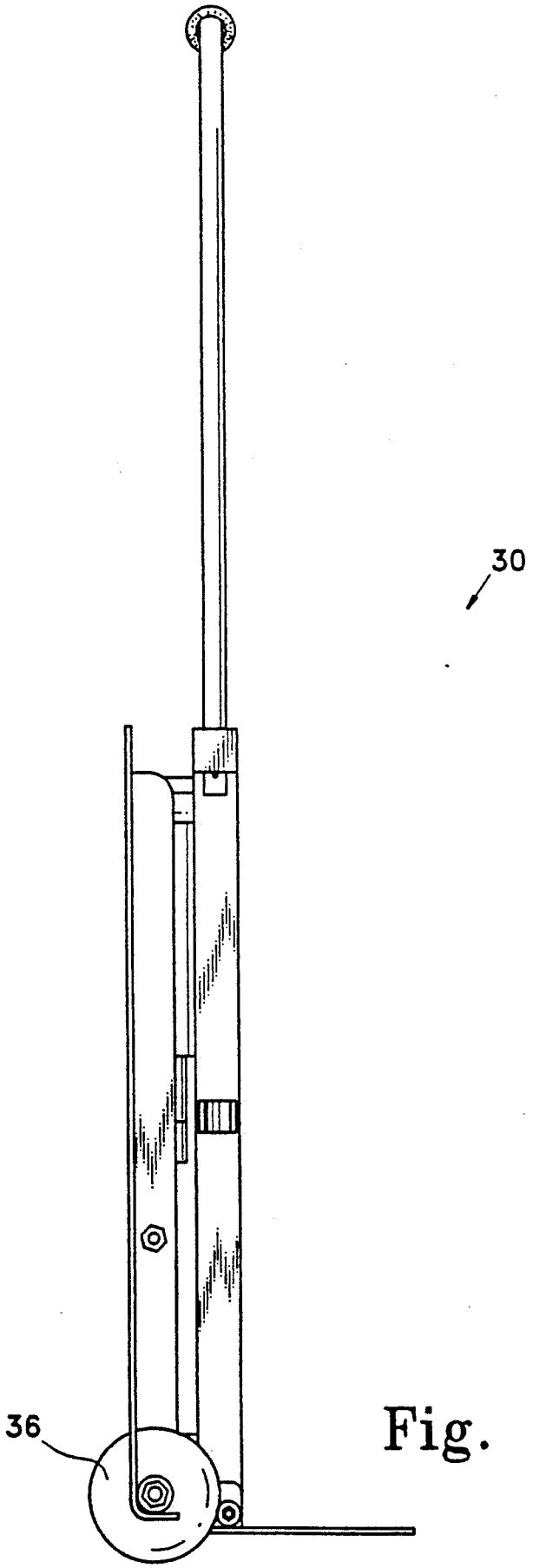
FIG. 4 is a side view of the embodiment shown in FIG. 3.
Figure 5A:
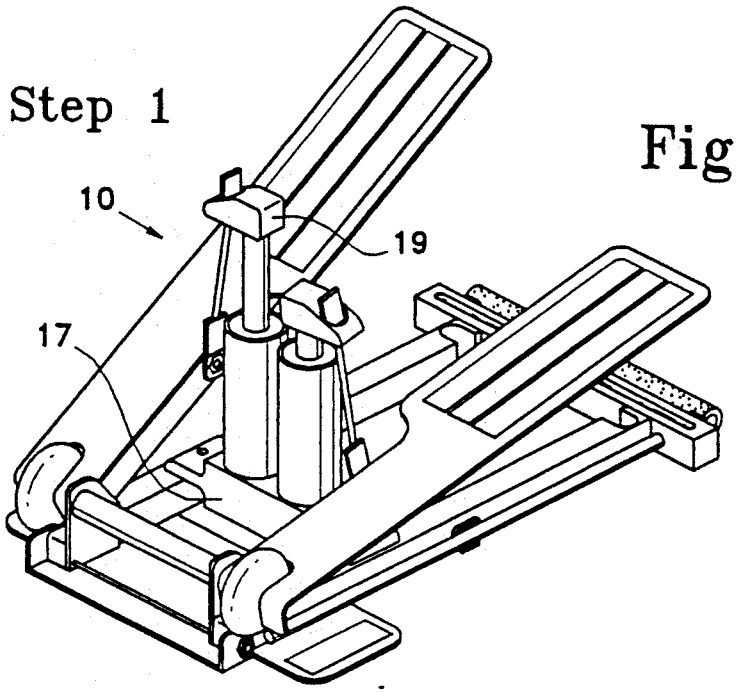
FIGS. 5*a–e* are step-by-step illustrations of the conversion of one embodiment of the present invention from the exercising mode of operation to the baggage toting mode of operation.
Figure 5B:
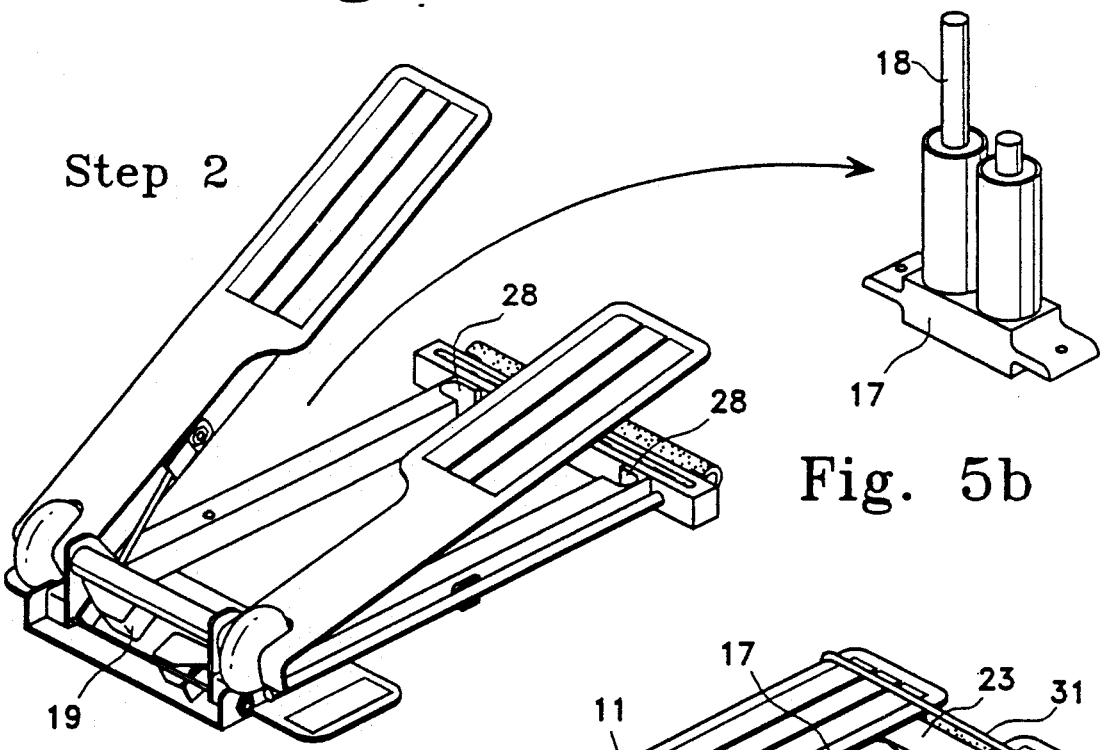
Figure 5C:
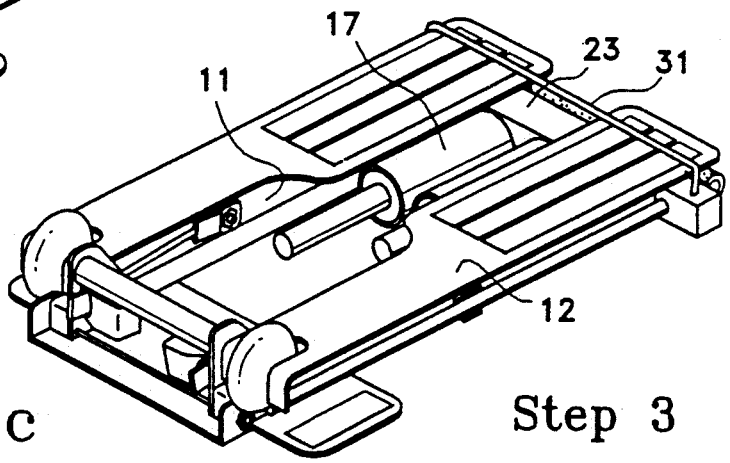
Figure 5D:
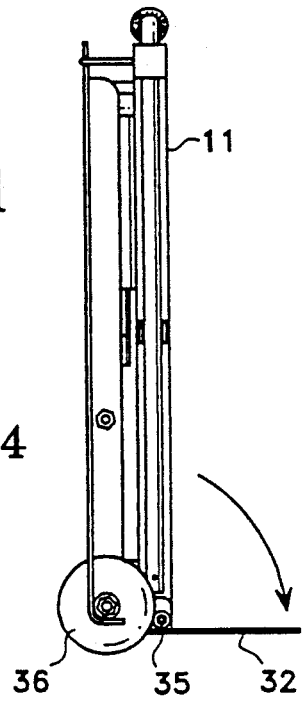
Figure 5E:
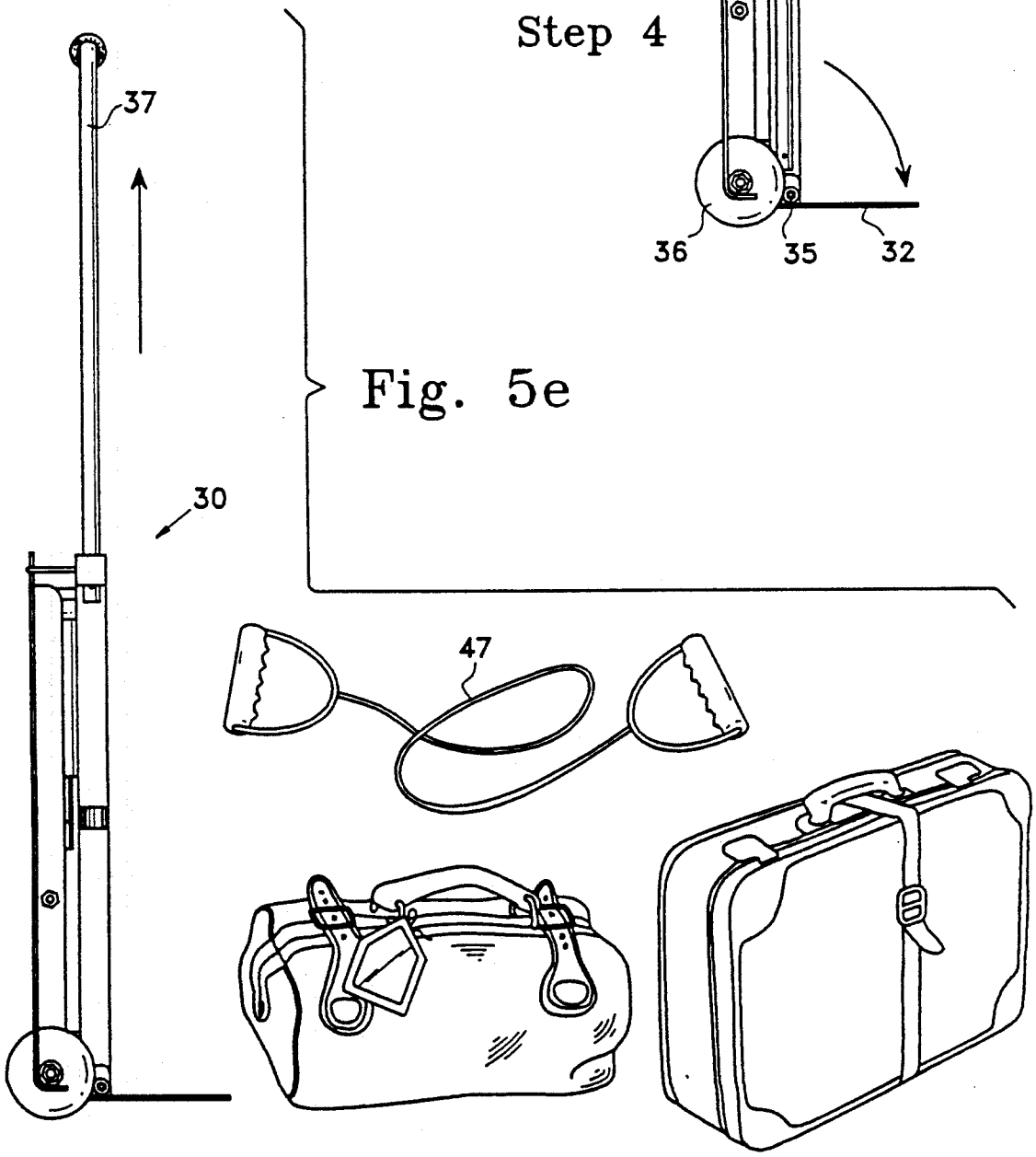
Figure 6A:
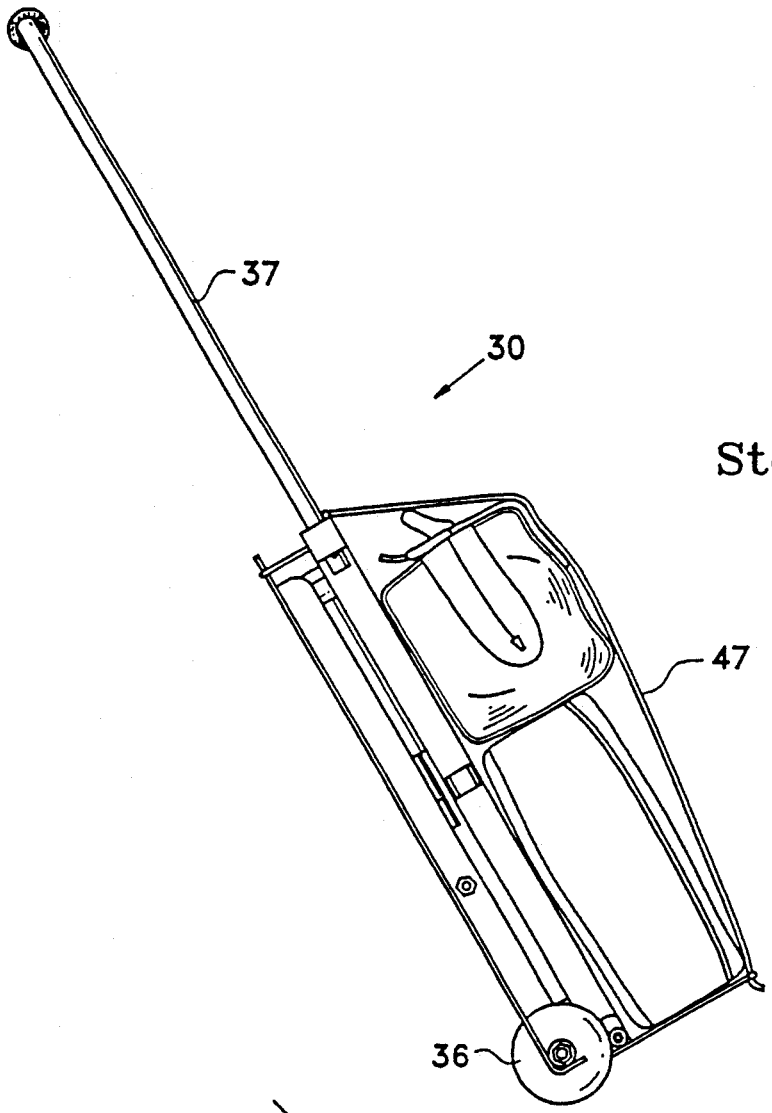
FIGS. 6*a–e* are step-by-step illustrations of the conversion of one embodiment of the present invention from the baggage toting mode of operation to the exercising mode of operation.
Figure 6B:
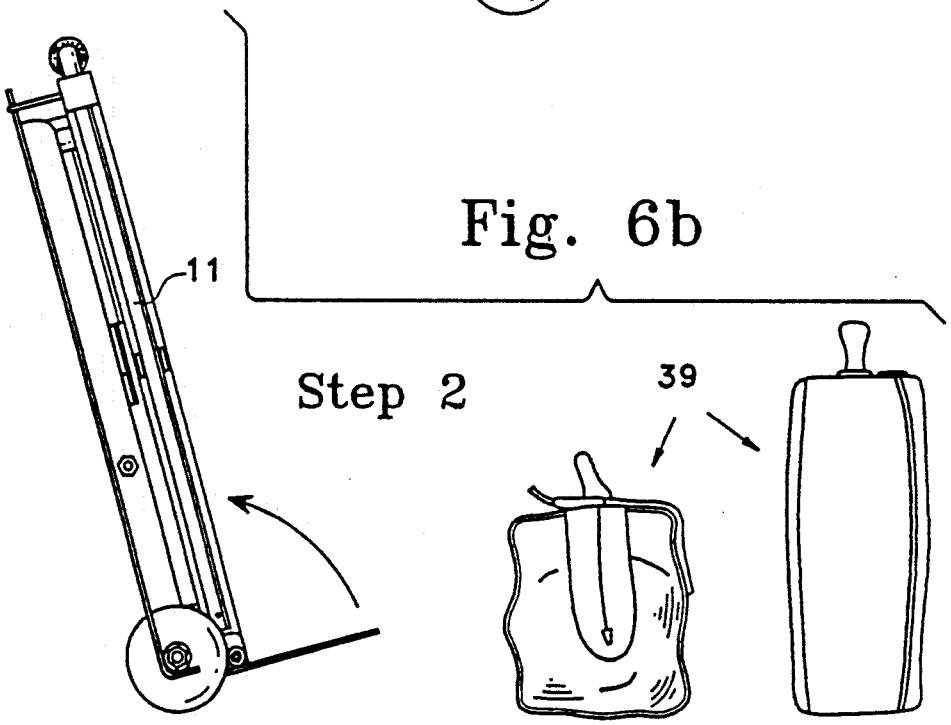
Figures 6C, 6D, 6E:
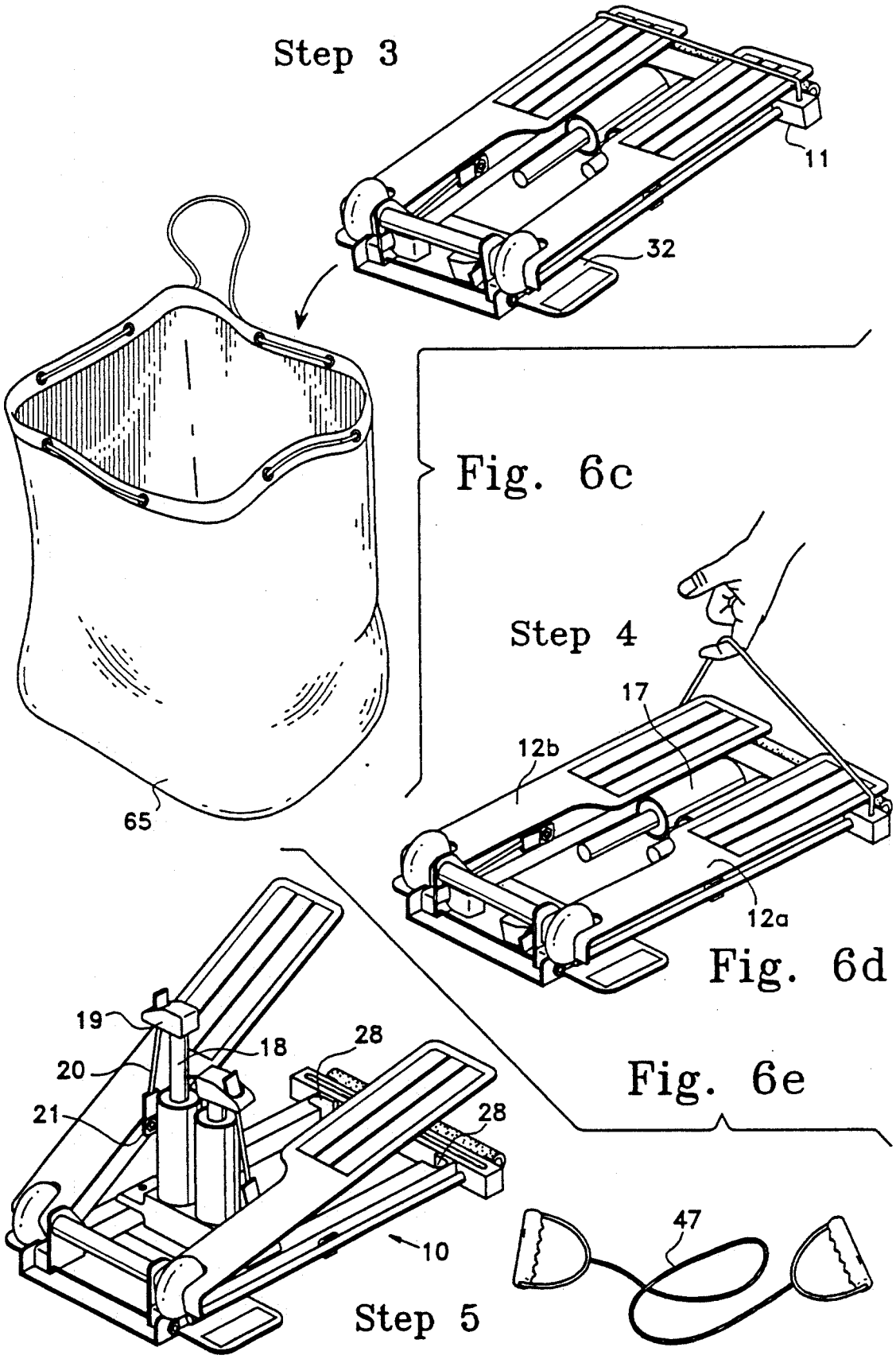
Figure 8B:
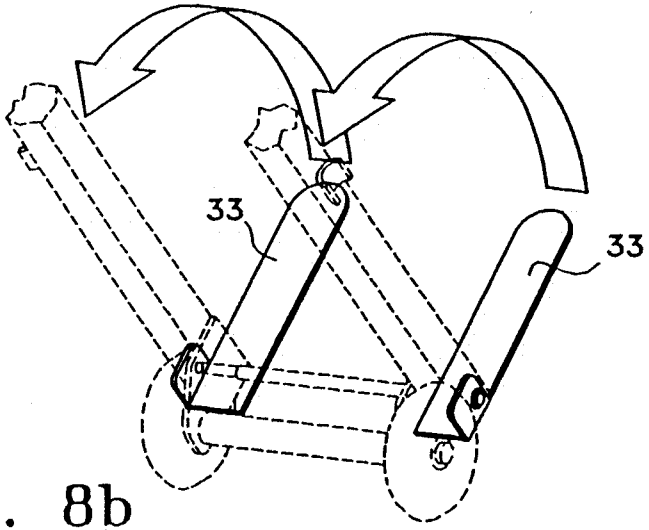
FIGS. 8*a–c* show a few various embodiments of the folding load supporting plate. The arrows are illustrative of the anticipated travel of each embodiment as the present invention is transformed from one mode to the other.
Figure 8C:
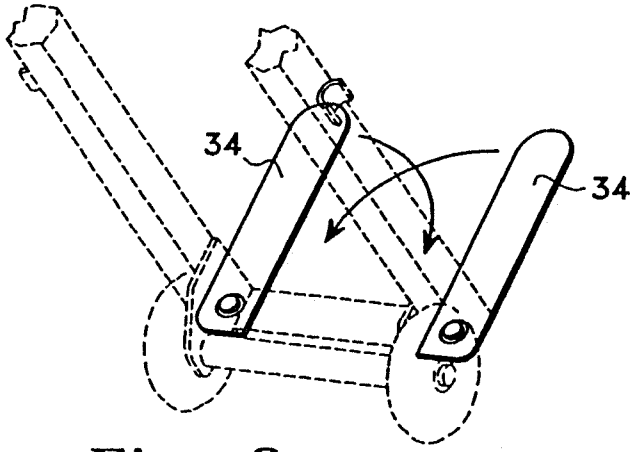
Figure 8A:
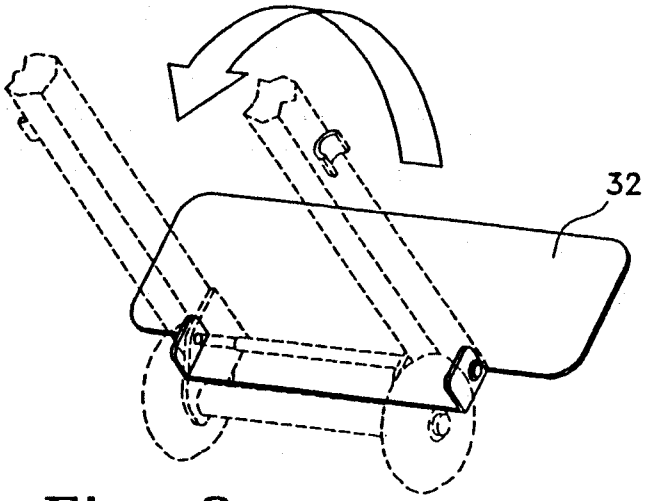
Figure 7:
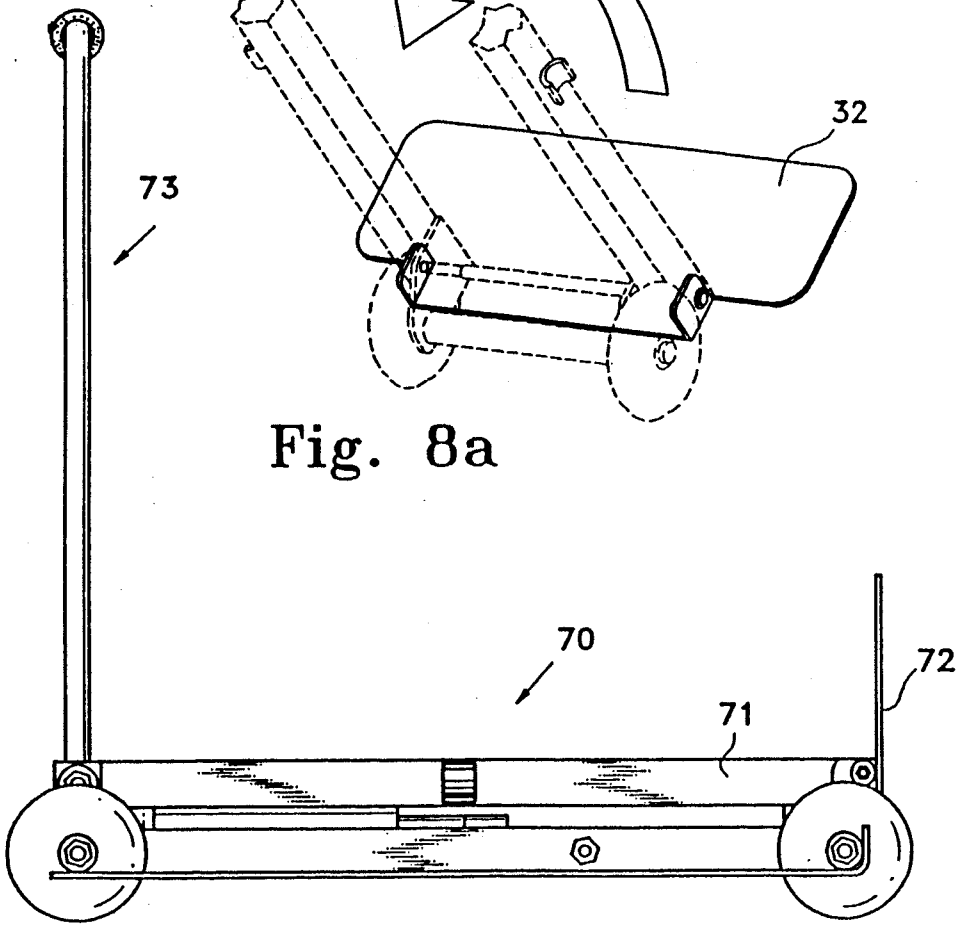
FIG. 7 is a side view of another embodiment of the present invention, shown in the baggage toting mode of operation.

Referring to FIGS. 3 and 4, baggage carrier (30) can be seen from additional preservatives. While the present embodiment employs a single pair of wheels (36), other rolling means may be used with minor changes. FIG. 7 shows an embodiment (70) which utilizes two pair of wheels, and maintains frame (71) in a horizontal orientation. In this embodiment, handle portion (73) would be designed to extend perpendicularly from frame (71), while plate (72) would serve as a lateral support. Other configurations which use substantially the same means, in substantially the same way, to achieve substantially the same result are possible, and should be considered to fall within the scope of the present invention. For instance, FIGS. 8*a*, 8*b* and 8*c* show just three different designs possible for the means for retaining baggage upon carrier (30). FIG. 8*a* shows the standard full-width load supporting plate (32) which flips upward when not in use. FIG. 8*b* shows a design which also flips upward, but comprises two flat stock prongs (33), while FIG. 8*c* presents a double rod (34) design which fold laterally when not in use. There is almost an unlimited number of designs possible, and known to those skilled in the luggage carrier art, certainly too many to enumerate herein. Cumulatively these designs are referred to as load supporting plate (32).

Figure 10B:
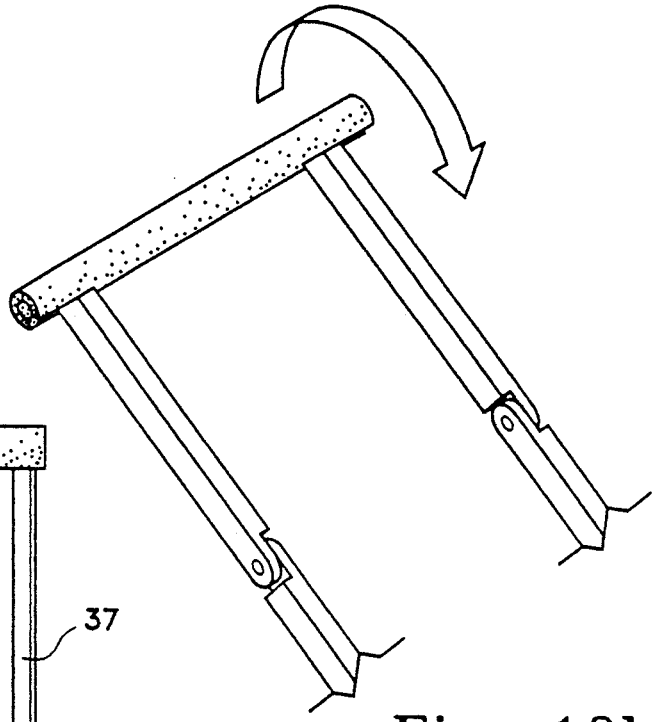
FIGS. 10*a–b* show a few various embodiments of the retractable handle portion. The arrows are illustrative of the anticipated travel of each embodiment as the present invention is transformed from one mode to the other.
Figure 10A:
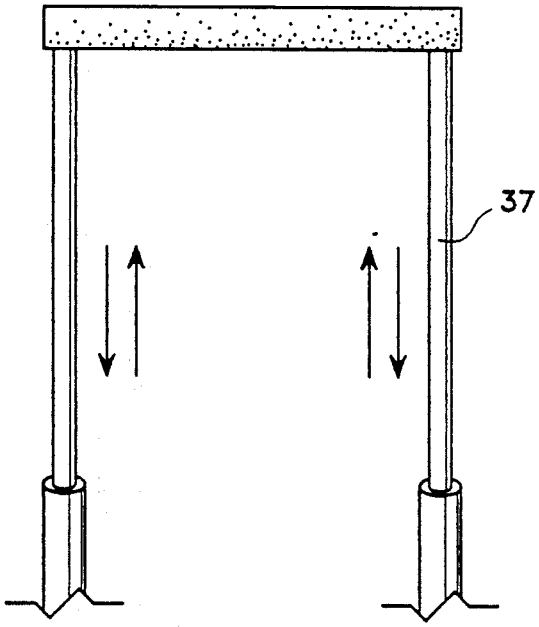

With respect to handle (37), FIG. 10*a* shows more clearly the retractable and locking features of this element. Alternatively, FIG. 10*b* shows a folding handle which may be used in other embodiments of the present invention. Still other design options exist, and the scope of the invention should not be considered to be limited to the above two design features. To the extent that others perform in substantially the same way, to achieve substantially the same result, these too should be considered to fall within the breadth of this invention.

Referring now to FIGS. 6*a–e*, an illustration is shown of the means for selectively engaging in which baggage carrier (30) is converted back to stair stepping simulator (10). In step 1 carrier (30) is shown in use, having various pieces of baggage retained thereon by elastic band (47). In step 2, if this is not already done, any baggage (39) should be removed from carrier (30). At this time handle (37) is retracted within frame (11). In step 3 load supporting plate (32) is folded up 90° to a position parallel to main frame (11). At this point the apparatus is completely compacted and capable of storage in bag (65).

To continue selective engagement of stair stepping simulator (10), step 4 involves placing main frame on a surface with force engaging plates (12*a–b*) facing upward. Plates (12*a–b*) should be unsecured at this point as well. In step 5 pistons (17) are removed from their storage position within notches (28) and placed upon nubs (29) of main frame (11). Cap (19) on each cable (20) attached at point (21) to each plate (12*a–b*) is then placed in engagement with rod (18) on piston (17). Simulator (10) is now ready for operation by the user. In addition, elastic bands (47) may be attached for use as arm exercising bands.

Figure 12:
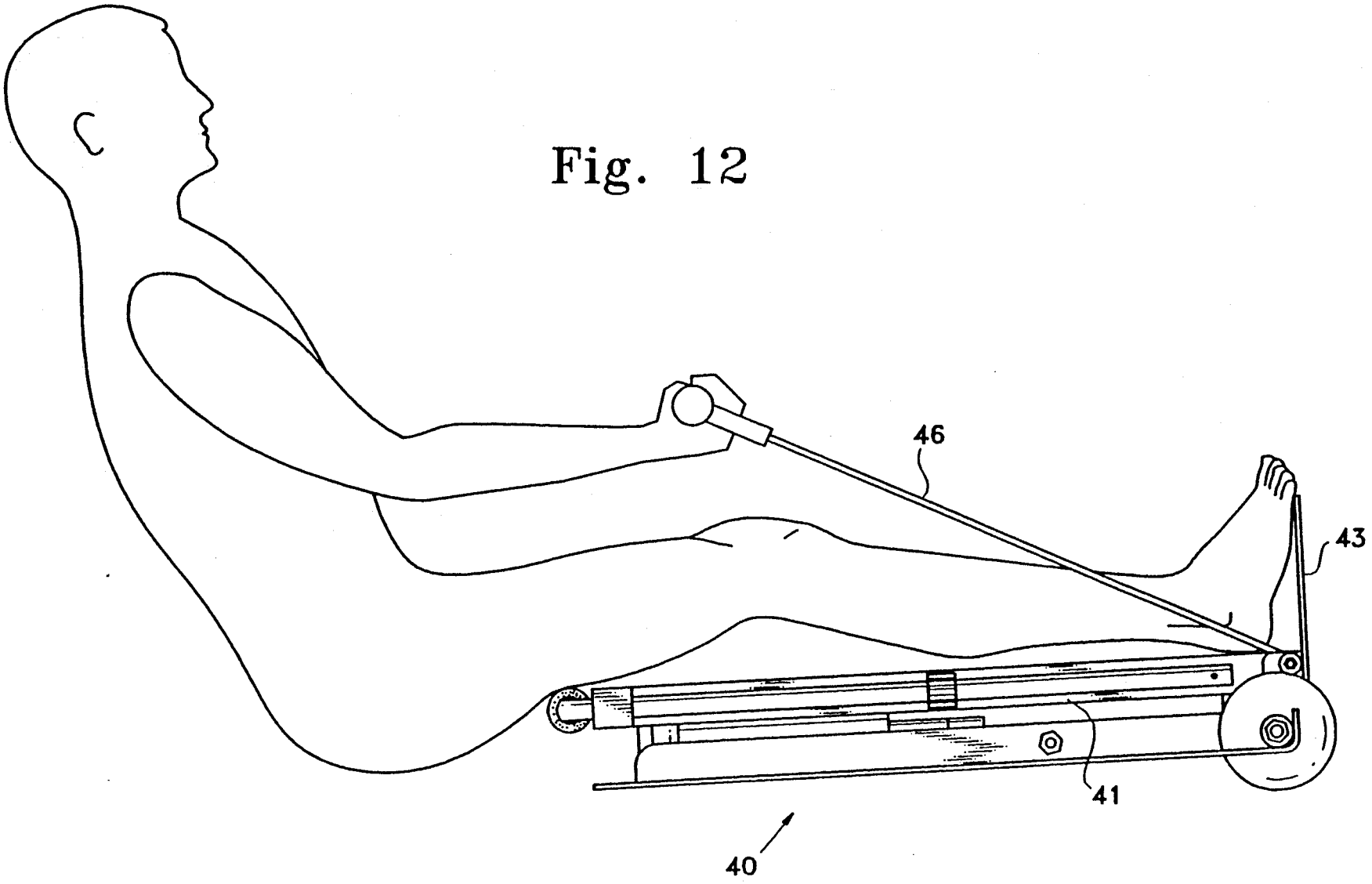
FIG. 12 is a view of another embodiment of the present invention, shown in the exercising mode of operation.

Naturally, simulator (10) is but one type of exerciser that may lend itself to the above conversion. FIG. 12 shows basic rowing machine (40) having main frame (41), feet restraint (43), and resistive members (46) attached at a point to main frame (41). Other means may be provided for resistive members (46), but basically the conversion to carrier (30) would be very similar to the method previously discussed.

Figure 13:
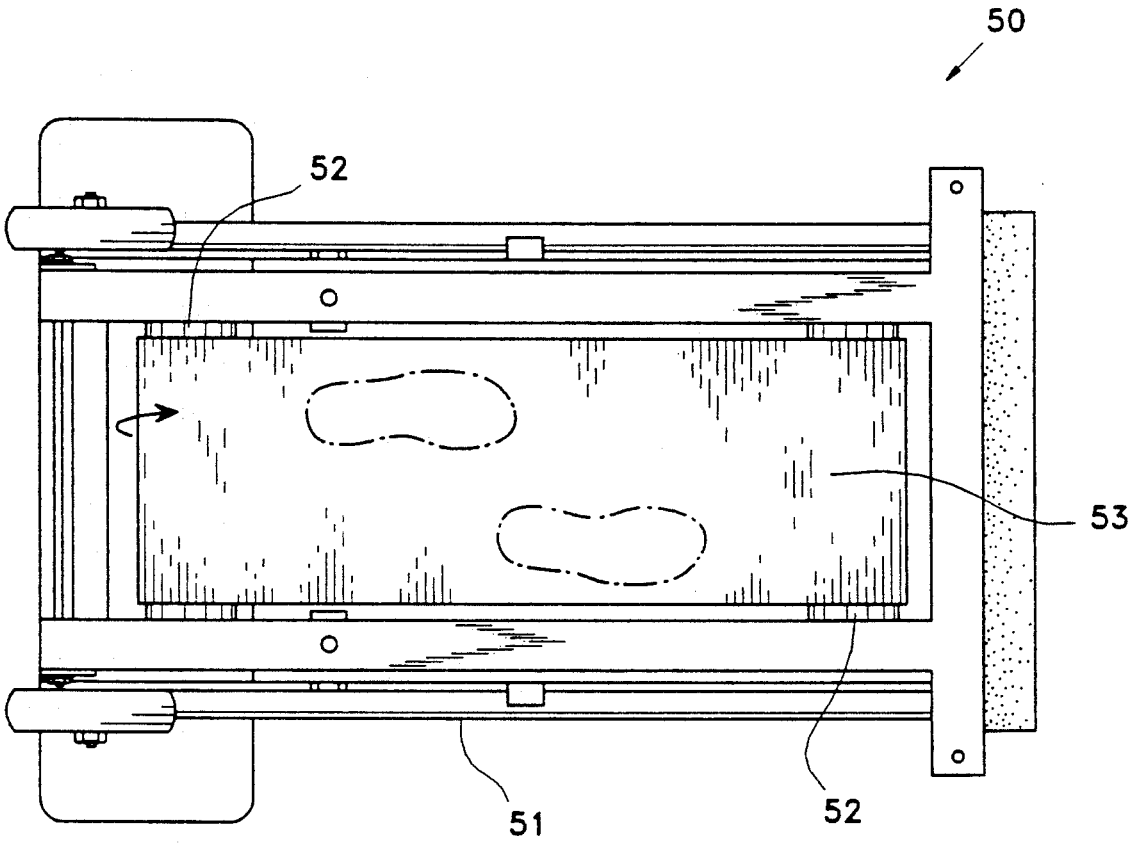
FIG. 13 is a top view of another embodiment of the present invention, shown in the exercising mode of operation.
Figure 14:
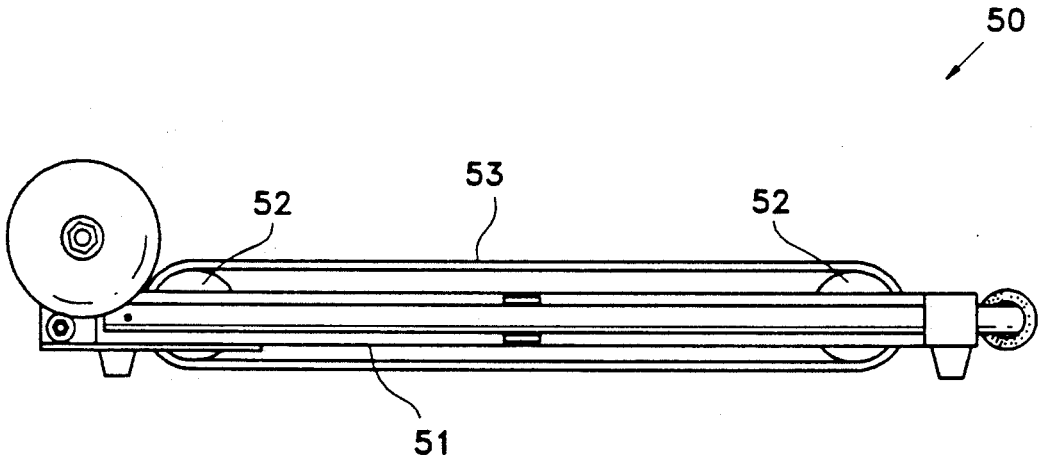
FIG. 14 is a side view of the embodiment shown in FIG. 13.

Likewise, FIGS. 13 and 14 show running/walking simulator (50) having main frame (51), and resistive means (52) which is directly responsive to conveyor surface (53). Unlike the previous two embodiments of the exercising apparatus, running/walking simulator (50) does not employ hydraulic pistons or elastic bands as resistive means (52). Instead, it is anticipated that simulator (50) may use rollers and/or a low friction surface to carry conveyor surface (53). This design may also be provided with a resistive friction clutch with manually adjustable friction intensity, a centrifugal clutch capable of providing a variable friction resistance, or a variety of other means. These type of devices are well know by those skilled in the exercise art.

Figure 15:
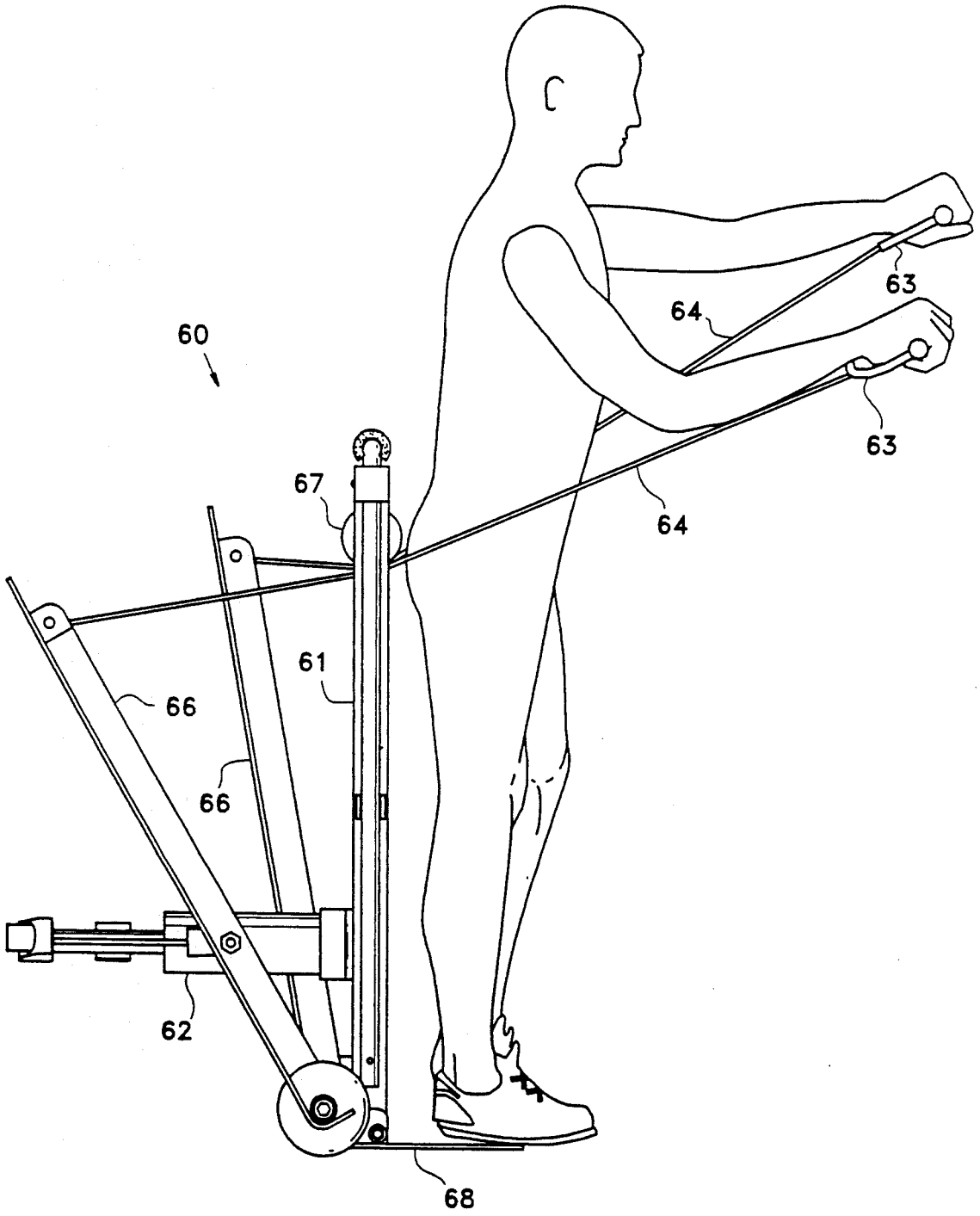
FIG. 15 shows another embodiment of the present invention in the exercising mode of operation.
Figure 16:
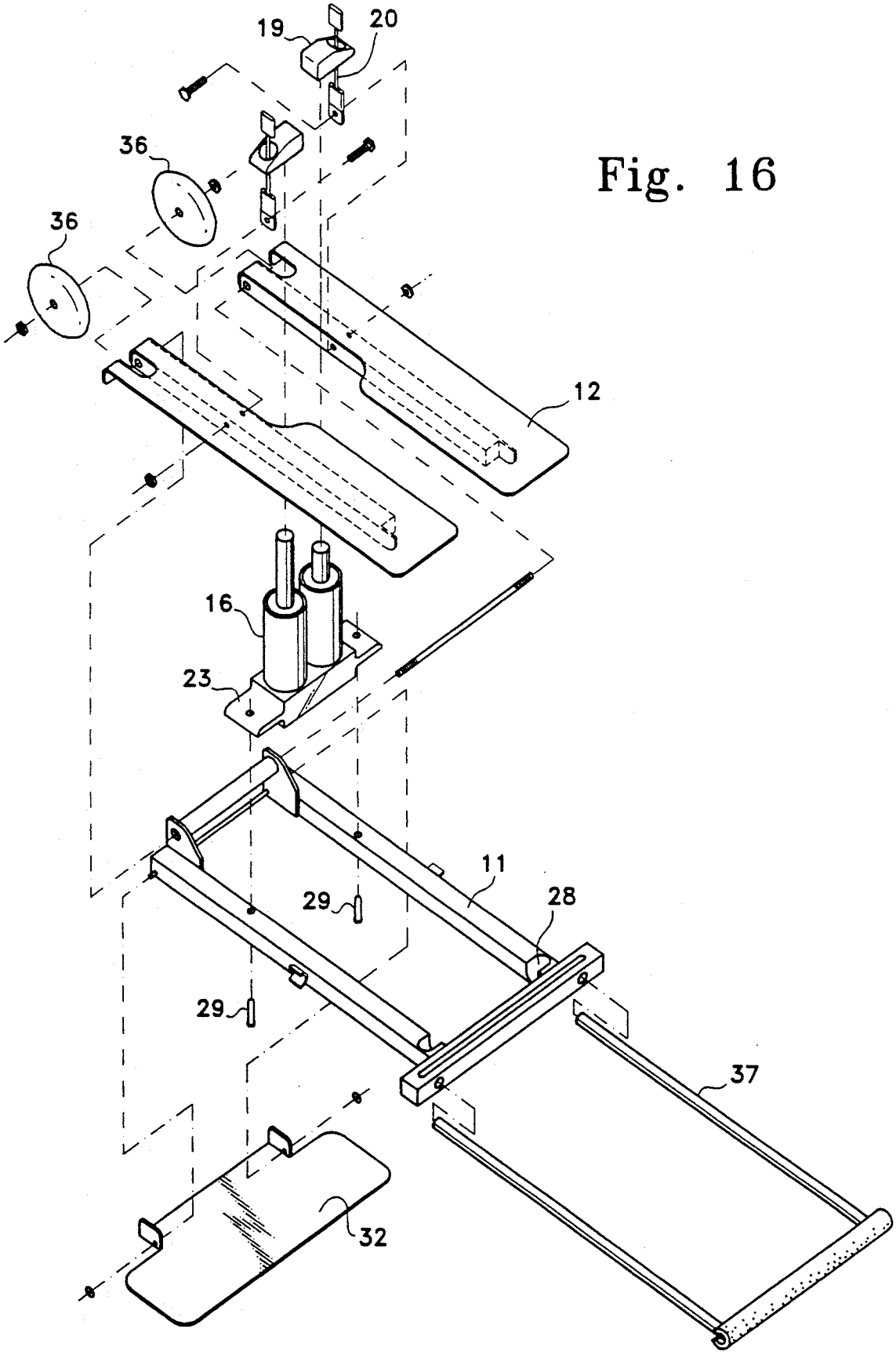
FIG. 16 is an exploded view of the embodiment shown in FIG. 1.
Figure 19:
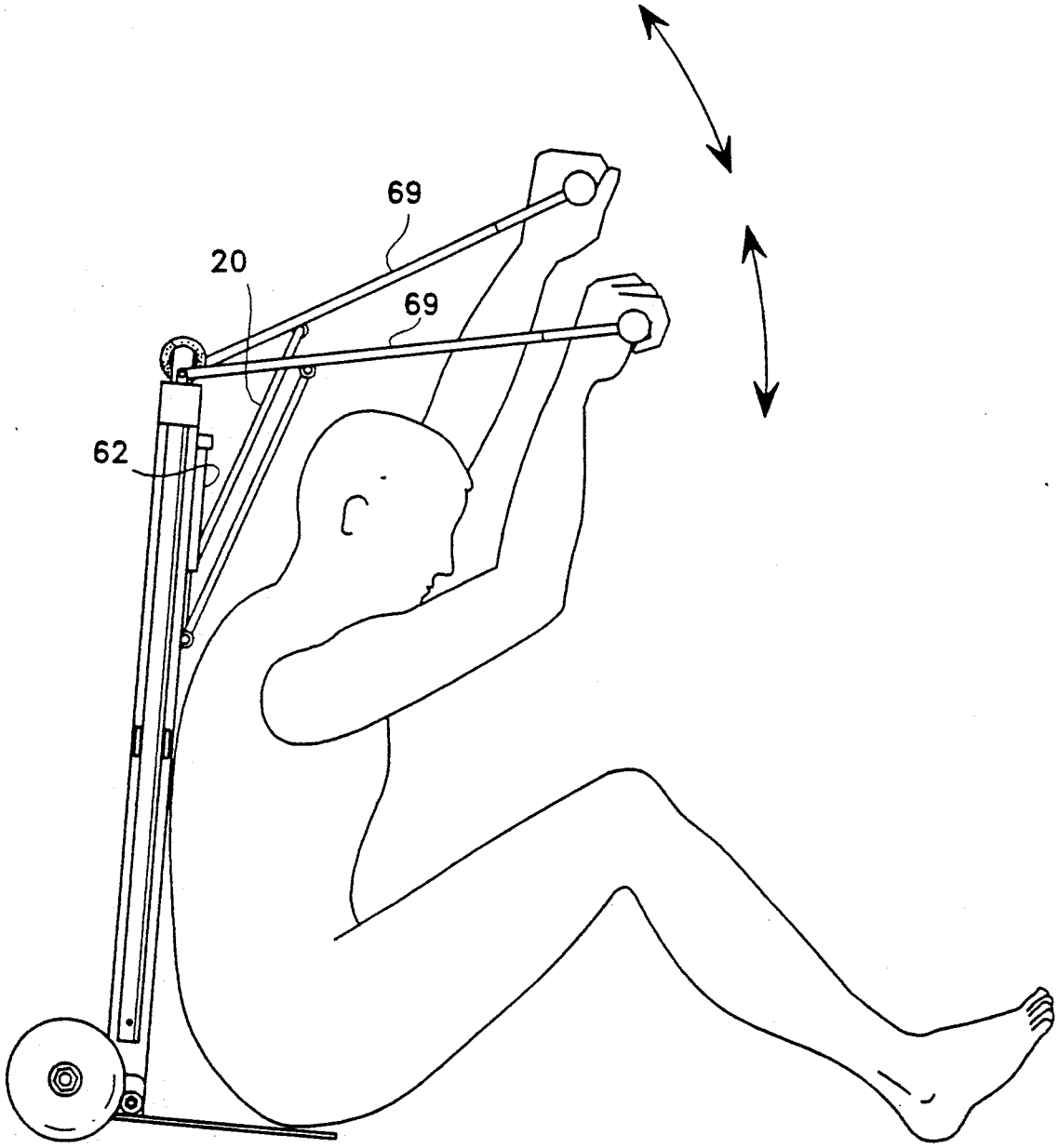
FIG. 19 shows an additional embodiment of weight lifting machine exerciser, where the independent foldable handle portions engage the resistive means.

Referring to FIG. 15, still another possible exercising embodiment can be understood. Weight lifting machine (60) is shown with main frame (61), and resistive means (62) having cords (64) with grips (63) attached to the underside of force engaging plates (66), and running through pulleys (67). Resistive means (62), in this particular case shown as pistons, is positioned to engage plates (66), as shown in FIG. 9*a*. Weight lifting machine (60) is positioned on end in a vertical orientation with carrier plate (68) extended. The user may stand or sit on plate (68) to provide stability to machine (60) during use. Alternatively, as shown in FIG. 19, folding handle portions (69), which may be designed as two independent sections, can be similarly attached to resistive means (62) while in its stored position, shown in step 3 of FIG. 5*c*, via cables (20).

Figure 20:
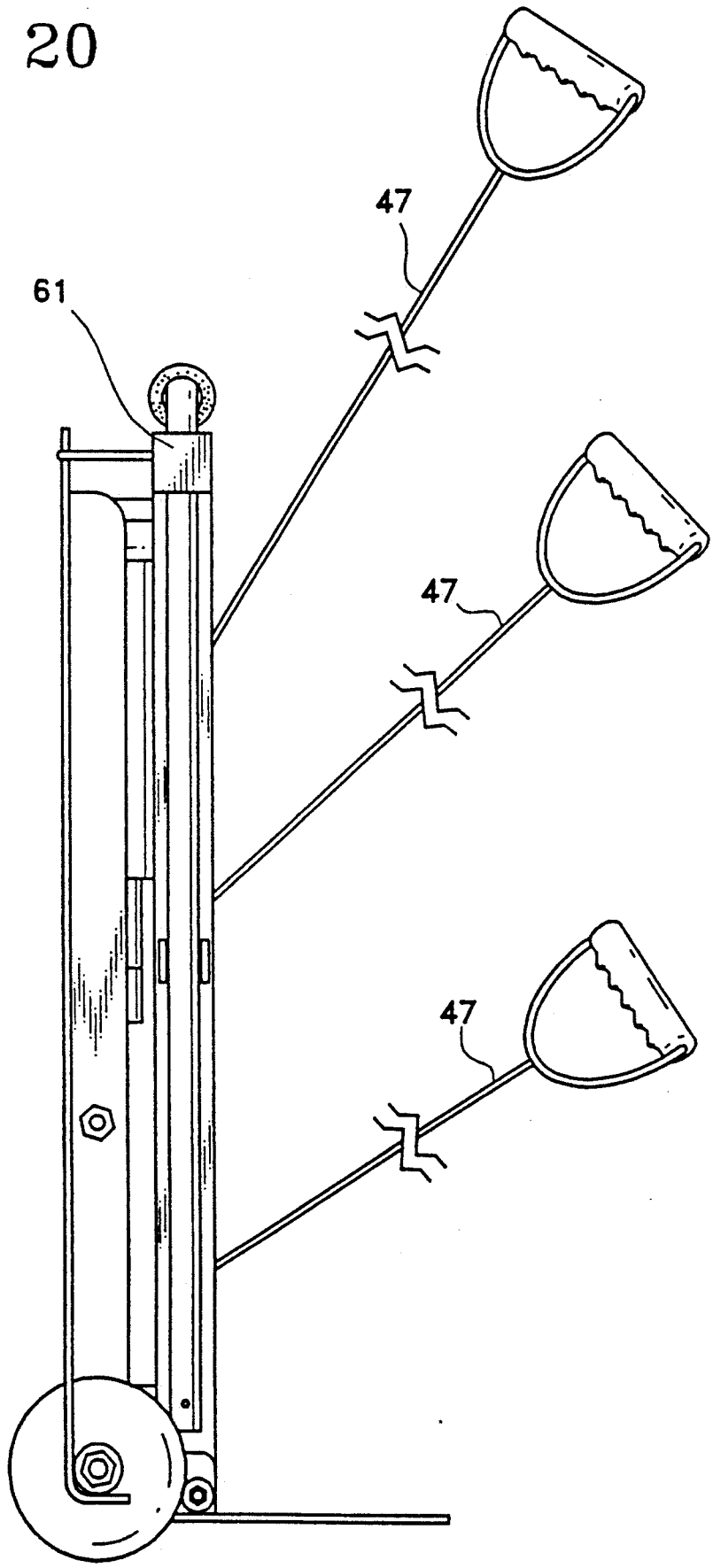
FIG. 20 shows still another embodiment of weight lifting machine exerciser, where elastic bands attached at various points to the main frame provide a resistive force.

Finally, as shown in FIG. 20, elastic bands (47) may act as resistive means by mere attachment to various points of main frame (61). When attached, the user may work against the natural elasticity of bands (47) to achieve a cardiovascular workout. Numerous other embodiments are possible using the basic elements of the present invention, and should therefore be considered to fall within the intended scope and spirit of the claimed invention.

The foregoing discussion and the claims which follow describe the preferred embodiments of the present invention. Particularly with respect to the claims, it should be understood, as previously stated, that changes may be made without departing from its essence. In this regard, such changes will still fall within the scope of the present invention. It simply is not practical to describe and claim all possible revisions to the present invention which may be accomplished. To the extent such revisions utilize the essence of the present invention, each would naturally fall within the breadth of protection encompassed by this patent. This is particularly true for the present invention since its basic concepts and understandings are fundamental in nature and can be broadly applied.

I claim:

1. A combination exerciser and baggage carrier apparatus comprising:

a. a rigid, main frame;

b. means for facilitating a cardiovascular workout, including first and second resistance means each having a length of travel and means for reciprocating said resistance means wherein said means for facilitating is integral to said main frame;

c. means for toting baggage including rolling means and means for retaining baggage, wherein said means for toting is integral to said main frame; and d. means for selectively engaging said means for facilitating and said means for toting, and wherein said means for selectively engaging is integral to said main frame; whereby said apparatus can be interconverted between an exercise mode and a baggage carrier mode.

2. A combination exerciser and baggage carrier as described in claim 1 wherein said means for facilitating comprises stationary means for resisting an applied force.

3. A combination exerciser and baggage carrier as described in claim 2 wherein said means for means for resisting further comprises means for alternating direction of travel of said first and second resistive means.

4. A combination exerciser and baggage carrier as described in claim 2 wherein said first resistive means and second resistive means opposingly interact.

5. A combination exerciser and baggage carrier as described in claim 2 wherein said first resistive means and second resistive means are independent of one another.

6. A combination exerciser and baggage carrier as described in claim 3 or 4 wherein said means for resisting comprises at least one piston member.

7. A combination exerciser and baggage carrier as described in claim 5 wherein said means for resisting comprises at least one elastic band.

8. A combination exerciser and baggage carrier as described in claim 2 wherein said means for resisting further comprises at least two force engaging plates, at least one each of which is responsive to said first and second resistive means.

9. A combination exerciser and baggage carrier as described in claim 6 wherein said means for resisting further comprises at least two force engaging plates, at least one each of which is responsive to said first and second resistive means.

10. A combination exerciser and baggage carrier as described in claim 8 wherein said means for resisting comprises means for varying the necessary applied force.

11. A combination exerciser and baggage carrier as described in claim 10 wherein said plates have length and said means for varying comprises said length of each plate.

12. A combination exerciser and baggage carrier as described in claim 2 wherein said means for facilitating is compactable.

13. A combination exerciser and baggage carrier as described in claim 12 wherein said means for resisting is detachable.

14. A combination exerciser and baggage carrier as described in claim 13 wherein said means for facilitating comprises a stair climbing simulator device.

15. A combination exerciser and baggage carrier as described in claim 13 wherein said means for facilitating comprises a rowing simulator device.

16. A combination exerciser and baggage carrier as described in claim 13 wherein said means for facilitating comprises a running simulator device.

17. A combination exerciser and baggage carrier as described in claim 13 wherein said means for facilitating comprises a walking simulator device.

18. A combination exerciser and baggage carrier as described in claim 13 wherein said means for facilitating comprises a weight lifting machine.

19. A combination exerciser and baggage carrier as described in claim 2, 14, 15 or 18 wherein said means for resisting comprises a compressible member.

20. A combination exerciser and baggage carrier as described in claim 2, 14, 15 or 18 wherein said means for resisting comprises an extensible member.

21. A combination exerciser and baggage carrier as described in claim 2, 14, 15, 16, 17 or 18 wherein said means for resisting comprises a friction member.

22. A combination exerciser and baggage carrier as described in claim 1 wherein said means for retaining comprises a load supporting plate.

23. A combination exerciser and baggage carrier as described in claim 1 wherein said means for retaining comprises at least one elastic band.

24. A combination exerciser and baggage carrier as described in claim 1 wherein said means for toting further comprises means for guiding said means for toting.

25. A combination exerciser and baggage carrier as described in claim 24 wherein said means for guiding comprises a handle.

26. A combination exerciser and baggage carrier as described in claim 2 wherein said means for selectively engaging comprises means for compacting said means for facilitating.

27. A combination exerciser and baggage carrier as described in claim 26 wherein said means for compacting said means for facilitating comprises means for detaching said means for resisting.

28. A combination exerciser and baggage carrier as described in claim 1 wherein said means for selectively engaging comprises means for compacting said means for toting.

29. A combination exerciser and baggage carrier as described in claim 28 wherein said means for compacting said means for toting comprises:

a. means for retracting said handle; and b. means for collapsing said load supporting plate.

30. A combination exerciser and baggage carrier apparatus comprising:

a. a main, rigid frame and means for retaining baggage;

b. at least one reciprocating member;

c. at least one force engaging plate, wherein said plate is pivotally mounted upon said rigid frame and engages said reciprocating member;

d. a handle, wherein said handle is retractable within said main, rigid frame;

e. a load supporting plate positioned upon said frame opposite said force engaging plate; and f. at least a single rolling means attached to said rigid frame; whereby said apparatus can be interconverted between an exercise mode and a baggage carrier mode.

31. A combination exerciser and baggage carrier as described in claim 30 wherein said apparatus comprises two reciprocating members, and wherein said members are opposingly interactive to one another.

32. A combination exerciser and baggage carrier as described in claim 31 wherein said reciprocating members are piston members.

33. A combination exerciser and baggage carrier as described in claim 30 wherein each said reciprocating member requires a necessary amount of applied force, and wherein said apparatus comprises means for varying the necessary amount of applied force.

34. A combination exerciser and baggage carrier as described in claim 33 wherein each said force engaging plate has length and wherein said means for varying comprises said length of said force engaging plate.

35. A combination exerciser and baggage carrier as described in claim 30 or 33 and further comprising means for selectively engaging said exerciser and said luggage carrier.

36. A combination exerciser and baggage carrier as described in claim 35 wherein said means for selectively engaging comprises:

a. a mechanism for locking said handle in a retracted position;
b. a mechanism for locking said handle in an extended position;
c. means for detaching said reciprocating member;
d. means for storing said reciprocating member within said frame;
e. means for securing said force engaging plate to said frame;
f. means for pivoting said load supporting plate between a vertical and a horizontal position.

37. A combination exerciser and baggage carrier as described in claim 36 wherein said means for storing comprises notches, and wherein said means for securing comprises elastic cord.

38. A combination exerciser and baggage carrier as described in claim 30 wherein said apparatus comprises two reciprocating members, and wherein said members operate independent of one another.

39. A combination exerciser and baggage carrier as described in claim 38 wherein said reciprocating members are piston members.

40. A combination exerciser and baggage carrier as described in claim 38 wherein said reciprocating members are elastic bands.

* * * * *